US011745522B2

(12) United States Patent
Ooi et al.

(10) Patent No.: US 11,745,522 B2
(45) Date of Patent: Sep. 5, 2023

(54) PRINTER WITH A CUTTING COMPONENT

(71) Applicant: TOSHIBA TEC KABUSHIKI KAISHA, Tokyo (JP)

(72) Inventors: Inseng Ooi, Singapore (SG); Kockkuan Tan, Singapore (SG); Kiyotaka Nihashi, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/829,395

(22) Filed: Jun. 1, 2022

(65) Prior Publication Data

US 2023/0143445 A1 May 11, 2023

(30) Foreign Application Priority Data

Nov. 8, 2021 (JP) ..... 2021-182092

(51) Int. Cl.

| | |
|---|---|
| ***B41J 11/66*** | (2006.01) |
| ***B41J 11/70*** | (2006.01) |
| ***B41J 11/00*** | (2006.01) |
| ***B65H 35/06*** | (2006.01) |

(52) U.S. Cl.

CPC ..... *B41J 11/70* (2013.01); *B41J 11/006* (2013.01); *B41J 11/0045* (2013.01); *B65H 35/06* (2013.01); *B65H 2801/12* (2013.01); *B65H 2801/27* (2013.01)

(58) Field of Classification Search

None

See application file for complete search history.

(56) References Cited

U.S. PATENT DOCUMENTS

2007/0065217 A1 3/2007 Yoshioka

FOREIGN PATENT DOCUMENTS

EP 2025522 A1 * 2/2009 ..... B26D 1/085

OTHER PUBLICATIONS

Extended European Search Report for European Patent Application No. 22189153.4 dated Mar. 13, 2023.

* cited by examiner

*Primary Examiner* — Leslie J Evanisko

(74) *Attorney, Agent, or Firm* — AMIN, TUROCY & WATSON, LLP

(57) ABSTRACT

A housing is provided with a sheet ejection port for discharging sheet that passed through a printing unit upward. A cutting unit is arranged between the printing unit and the sheet ejection port and cuts the sheet by either a method of cutting the sheet in the entire width direction or a method of leaving the central portion of the sheet in the width direction. First protrusions and second protrusions protruding from the inner periphery of the sheet ejection port are provided at a plurality of locations along the width direction of the sheet. The first protrusion faces a first surface of the sheet and the second protrusion faces a second surface, which is the back surface of the first surface of the sheet. The first protrusion and the second protrusion are provided at positions deviated from each other in the sheet width direction and bend the sheet in an undulating shape in the width direction therebetween. Further, protrusion height of at least one of the first protrusions and the second protrusions in the central portion in the width direction of the sheet is lower than protrusion heights of the first protrusions and the second protrusions in other regions.

20 Claims, 12 Drawing Sheets

PRINTER WITH A CUTTING COMPONENT

CROSS-REFERENCE TO RELATED APPLICATION

This application is based upon and claims the benefit of priority from Japanese Patent Application No. 2021-182092, filed on Nov. 8, 2021, the entire contents of which are incorporated herein by reference.

FIELD

Embodiments described herein relate generally to a printer.

BACKGROUND

In a related art, a printer that prints while conveying a strip-shaped sheet was used. As such a printer, for example, there is a receipt printer. In addition, some such printers enable both a full cut that completely cuts the ejected sheet in the width direction and a partial cut that leaves a partial area of the width direction (for example, the central portion). Further, some such printers convey and eject the sheet upwards.

Some printers that eject sheet upward as described above have been devised as disclosed in JP-A-2007-076134. That is, to prevent the inconvenience that the fully cut sheet falls below the cut position, the ribs provided at the sheet ejection port hold the sheet by alternately pressing the sheet from the front and back.

Here, the structure for holding the full-cut sheet as described above does not correspond to the ejection of the partially cut sheet. In the case of full cut, the cut sheet held by the ribs overlaps with the sheet to be conveyed next, and thus, a frictional force acts between the sheets. As a result, the cut sheet also moves between the ribs together with the next sheet. However, since the partially cut sheet does not overlap with the next sheet in the thickness direction, the sheet is not conveyed by the frictional force between the sheets as described above. In the case of partial cut, the conveying force is transmitted from the rear sheet to the front sheet only at the connected part. Thus, if the sheet holding force of the ribs is too strong, the sheet is broken at the connected part of the front and rear sheet and a sheet jam occurs. Further, if the ribs are simply lowered or the number of ribs is reduced to weaken the sheet holding force of the ribs, the originally required function of holding the fully cut sheet becomes uncertain depending on the degree of the ribs.

DESCRIPTION OF THE DRAWINGS

FIG. 6-1 is a diagram showing a partial cross-sectional view of a sheet passage path at the sheet ejection port;

FIG. 6-2 is a diagram showing a partial cross-sectional view of the sheet passage path at the sheet ejection port;

FIG. 8-1 is a diagram showing a partial cross-sectional view of a state of sheet ejection in the partial cut;

FIG. 8-2 is a diagram showing a partial cross-sectional view of a state of sheet ejection in the partial cut;

FIG. 8-3 is a diagram showing a partial cross-sectional view of a state of sheet ejection in the partial cut.

DETAILED DESCRIPTION

Embodiments of the present disclosure provide a printer having a structure capable of holding a full-cut sheet ejected upward and having a structure in which jam of a partial-cut sheet is unlikely to occur.

In general, according to one embodiment, a printer includes a printing unit configured to print on a strip-shaped sheet, a housing configured to house the sheet and the printing unit and provided with a sheet ejection port for ejecting the sheet that passed through the printing unit upward, a cutting unit arranged between the printing unit and the sheet ejection port and configured to cut the sheet by either a first method of cutting the sheet in the entire width direction or a second method of leaving the central portion of the sheet in the width direction, first protrusions protruding from the inner periphery of the sheet ejection port, and provided at a plurality of locations along the width direction of the sheet to face a first surface, which is the surface of the sheet on the side to be printed, and second protrusions protruding from the inner periphery of the sheet ejection port, provided at a plurality of locations along the width direction of the sheet at positions deviated from the first protrusions in the sheet width direction to face a second surface, which is the back surface of the first surface of the sheet, and configured to bend the sheet in an undulating shape in the width direction between the first protrusion and the second protrusion, in which a protrusion height of at least one of the first protrusions and the second protrusions in a predetermined region of the central portion of the sheet in the width direction is lower than protrusion heights of the first protrusions and the second protrusions in other regions.

Figure 1:
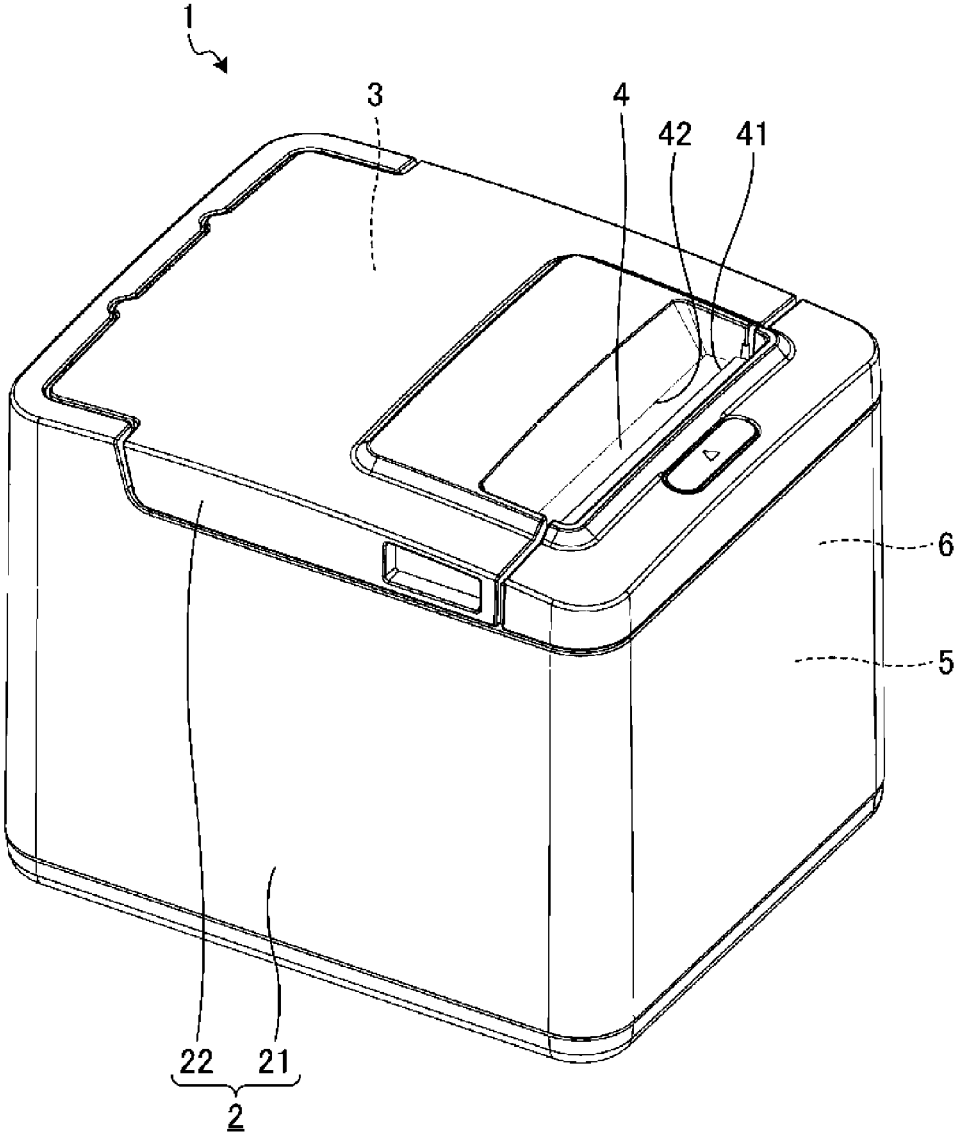
FIG. 1 is a perspective view illustrating the appearance of a printer according to an embodiment.
Figure 2:
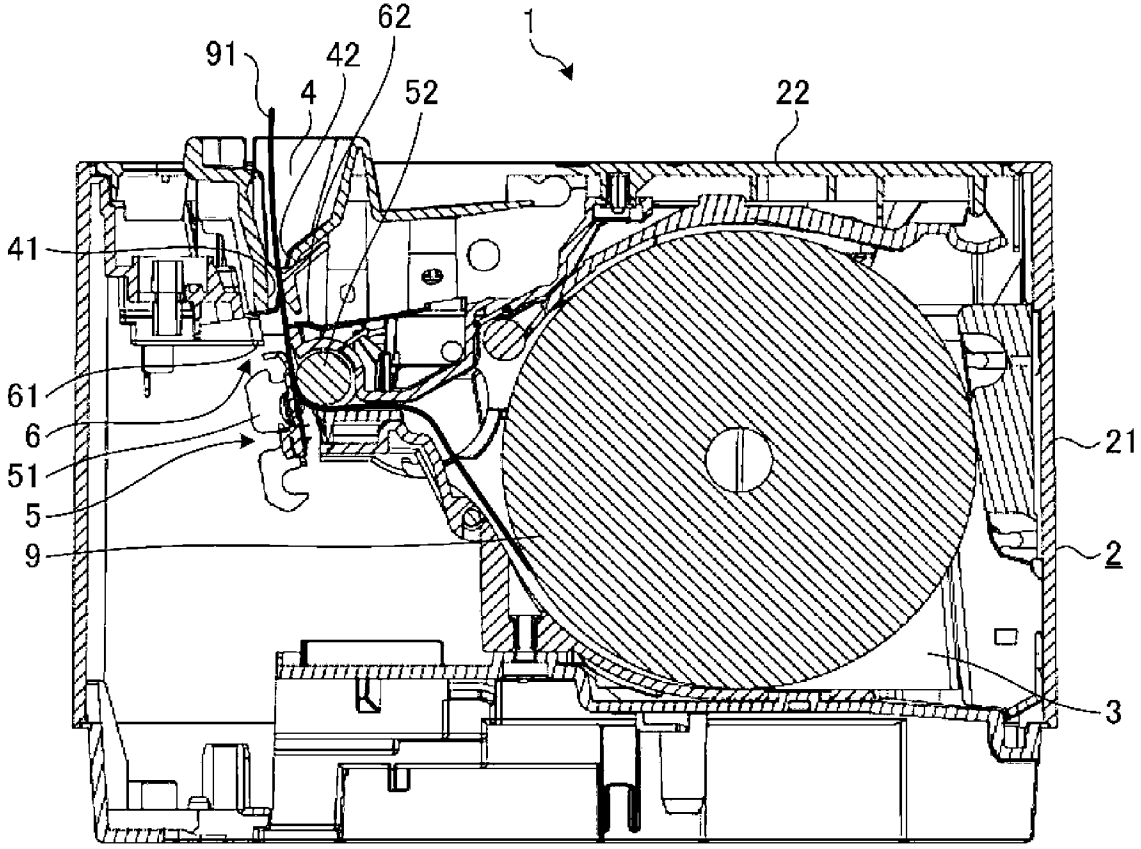
FIG. 2 is a schematic cross-sectional view showing an example of the internal structure of the printer.

The embodiment will be described with reference to the drawings. FIG. 1 is a perspective view illustrating the appearance of a printer 1 according to an embodiment. FIG. 2 is a schematic cross-sectional view showing an example of the internal structure of the printer 1.

The printer 1 is, for example, a thermal printer that prints information such as characters and figures on a sheet. The printer 1 is connected to, for example, a POS (Point of Sales) terminal (not shown), receives commodity information and sales information related to commodities sold to customers at a store from the POS terminal, prints the information on the sheet, and dispenses the sheet as a receipt (discharge of the sheet, sheet ejection).

The printer 1 includes a housing 2, a storage unit 3, a sheet ejection port 4, a printing unit 5, and a cutting unit 6.

The housing 2 includes a main body portion 21 and a lid portion 22. The main body portion 21 is a container having an opening on one side and includes the storage unit 3 for storing a roll sheet 9 inside. One side of the lid portion 22 is rotatably supported near the edge of the opening of the main body portion 21. With the rotation of the lid portion 22, the opening of the main body portion 21 is opened and closed, whereby the storage unit 3 is opened and closed. The roll sheet 9 is taken in and out of the main body portion 21 with the lid portion 22 open.

The roll sheet 9 is a roll of a strip-shaped sheet (for example, heat sensitive paper) 91, and the sheet 91 is pulled out from the outer peripheral portion at the end of the roll. The outer diameter of the roll sheet 9 gradually decreases as the sheet 91 is pulled out.

The printer 1 prints information on the sheet 91 pulled out from the roll sheet 9 stored in the storage unit 3 and ejects the sheet 91 that passed through the printing unit 5 from the sheet ejection port 4.

The sheet ejection port 4 is formed between the end of the lid portion 22 on the opposite side of the rotating end and the main body portion 21. The sheet ejection port 4 is a gap (slit) between a surface 41 facing the printing surface of the sheet 91 and a surface 42 facing the back surface of the printing surface of the sheet 91. The surface 41 is a part of the main body portion 21 and the surface 42 is a part of the lid portion 22. The sheet ejection port 4 is open upward and the printer 1 ejects the sheet 91 that passed through the printing unit 5 upward.

The printing unit 5 includes a printing head 51 and a platen 52.

The print head 51 is provided at a substantially intermediate position between the storage unit 3 and the sheet ejection port 4 in the main body portion 21 and is provided in the middle of the conveyance path of the sheet 91 pulled out from the roll sheet 9. The print head 51 is a line thermal head in which a large number of heat-generating elements are arranged on the line. The print head 51 drives the heat generating elements corresponding to the print pattern among the heat generating elements aligned on one line to generate heat, thereby, heating the sheet 91 to print information. The printed sheet 91 is discharged from the sheet ejection port 4 to the outside of the housing 2.

The platen 52 is a cylindrical roller whose surface is formed of an elastic material at least and is rotatably attached to the lid portion 22. If the lid portion 22 closes the opening of the main body portion 21, the platen 52 is located at a position facing the print head 51 and presses the print head 51. In this state, the sheet 91 pulled out from the roll sheet 9 is sandwiched between the print head 51 and the platen 52. The platen 52 rotates by the driving force of a motor (not shown) being transmitted, pulls out the sheet 91 from the roll sheet 9, and conveys the sheet toward the sheet ejection port 4.

The cutting unit 6 is arranged between the printing unit 5 and the sheet ejection port 4 and cuts the sheet 91 along the width direction of the sheet 91. The sheet width direction, the sheet thickness direction, and the sheet conveyance direction are orthogonal to each other.

The cutting unit 6 is driven by selectively adopting one of the following two methods as the cutting method. A first method is a method also called full cut, which cuts the sheet 91 in the entire width direction. A second method is a method also called partial cut, which leaves the central portion of the sheet 91 in the width direction.

The cutting unit 6 includes, for example, a fixed blade 61 having a straight cutting edge and a movable blade 62 having a cutting edge having a V-shaped recess in the center. The movable blade 62 is driven by a drive unit such as a motor (not shown), so as to move in a direction in which the cutting edge of the movable blade 62 is close to and separated from the cutting edge of the fixed blade 61. The moving direction of the movable blade 62 substantially coincides with, for example, the sheet thickness direction. In such a structure, full cut and partial cut can be used properly depending on the moving distance of the movable blade 62 with respect to the fixed blade 61. That is, by stopping the movement of the movable blade 62 to the extent that the V-shaped valley of the movable blade 62 does not reach the cutting edge of the fixed blade 61 and is maintained in a slightly separated state, the central portion of the sheet 91 in the width direction can be left uncut, which makes a partial cut.

Figure 3:
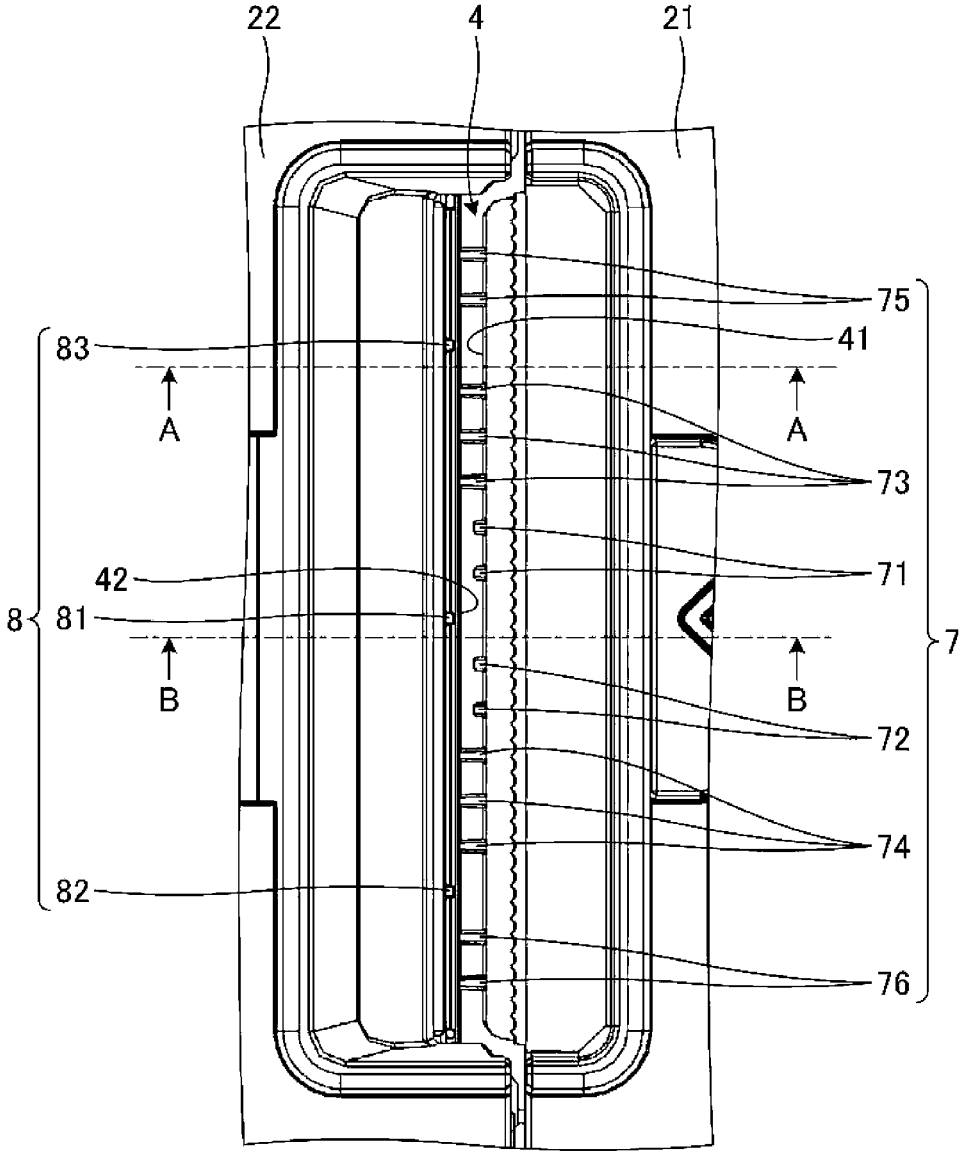
FIG. 3 is a plan view showing an example of the appearance of a sheet ejection port.

FIG. 3 is a plan view showing an example of the appearance of the sheet ejection port 4. The printer 1 further includes first protrusions 7 (71 to 76) and second protrusions 8 (81 to 83) inside the sheet ejection port 4.

The first protrusions 7 (71 to 76) protrude from the surface 41 constituting the inner periphery of the sheet ejection port 4, are provided at a plurality of locations along the width direction of the sheet 91, and face the surface of the sheet 91 (printing surface, first surface) on the side to be printed. Similarly, the second protrusions 8 (81 to 83) protrude from the surface 42 constituting the inner periphery of the sheet ejection port 4, are provided at a plurality of locations along the width direction of the sheet 91, and face the back surface (second surface) of the printing surface of the sheet 91.

Each of the protrusions 71 to 76 and 81 to 83 has a plate shape and is provided side by side in the width direction of the sheet 91 with the plate thickness direction facing the width direction of the sheet 91.

Further, the protruding direction of each of the protrusions 7 and 8 is, for example, along the thickness direction of the sheet 91 conveyed at each position. As a result, each of the protrusions 7 and 8 changes the moving direction of the sheet 91 during conveyance in the thickness direction thereof.

The first protrusions 7 are composed of the protrusions 71 and 72 located at the central portion in the width direction of the sheet 91, the protrusions 73 and 74 provided at positions sandwiching the protrusions 71 and 72 in the sheet width direction, and the protrusions 75 and 76 further sandwiching the protrusions 71 to 74 in the sheet width direction. Further, the second protrusions 8 are composed of the protrusion 81 located at the central portion in the width direction of the sheet 91, and the protrusions 82 and 83 provided at positions sandwiching the protrusion 81 in the sheet width direction.

Figure 4:
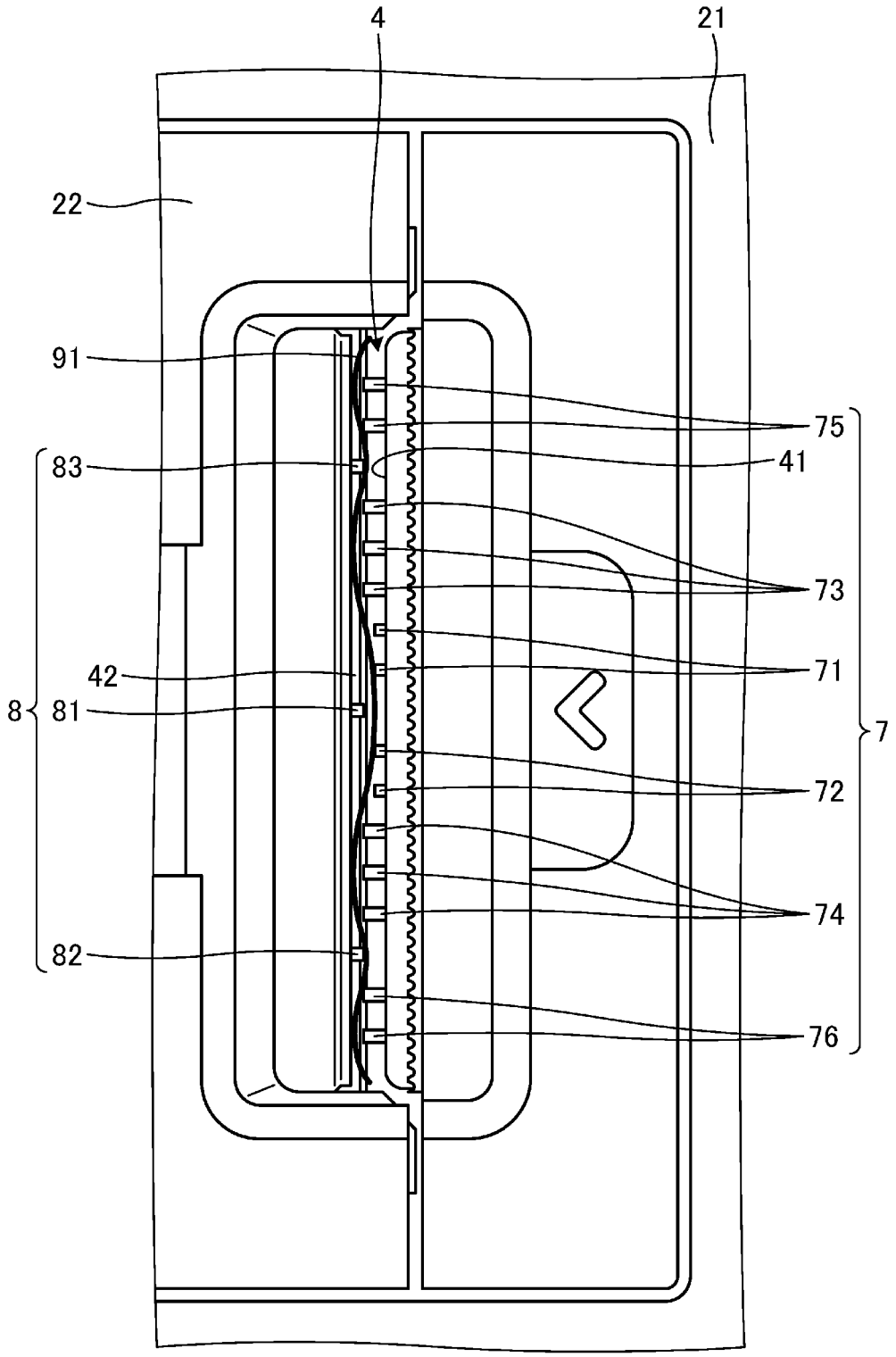
FIG. 4 is a plan view of the sheet ejection port showing an example of the degree of curvature of an ejected sheet.

The second protrusions 8 are provided at positions deviated from the first protrusions 7 in the width direction of the sheet 91. As a result, each of the protrusions 7 and 8 is alternately located in the order of the first protrusion 75, the second protrusion 83, the first protrusions 73 and 71, the second protrusion 81, the first protrusions 72 and 74, the second protrusion 82, and the first protrusion 76 in the sheet width direction. Further, as a result, the sheet 91 is curved in an undulating shape (wavy shape) in the width direction between the first protrusion 7 and the second protrusion 8. FIG. 4 is a plan view of the sheet ejection port showing an example of the degree of curvature of the ejected sheet 91. The sheet 91 is in close contact with the protrusions 7 and 8 due to its curved waist (elasticity that tries to return to a straight line from the curved state) and is held by the frictional force acting between the sheet 91 and the protrusions 7 and 8.

In the present embodiment, the protrusions 71 and 72 at the central portion in the sheet width direction are set to have a lower (smaller and shorter) protrusion height than the other protrusions 73 to 76. Further, in the present embodiment, the protrusions 73 to 76 are formed to have a constant protrusion height. Further, the protrusions 81 to 83 are formed to have a constant protrusion height in the present embodiment. As a result, in the predetermined region of the central portion of the sheet 91 in the width direction, the distance between the top of the first protrusion 7 and the top of the second protrusion 8 is wider (larger) than that in the other regions.

In the present embodiment, the heights of the protrusions 71 to 76 and 81 to 83 are set as described above, but in the implementation, the protrusion height of at least one of the first protrusions 7 and the second protrusions 8 in a predetermined region in the central portion in the width direction of the sheet 91 may be set lower than the protrusion heights of the first protrusions 7 and the second protrusions 8 in the other regions.

Figure 5:
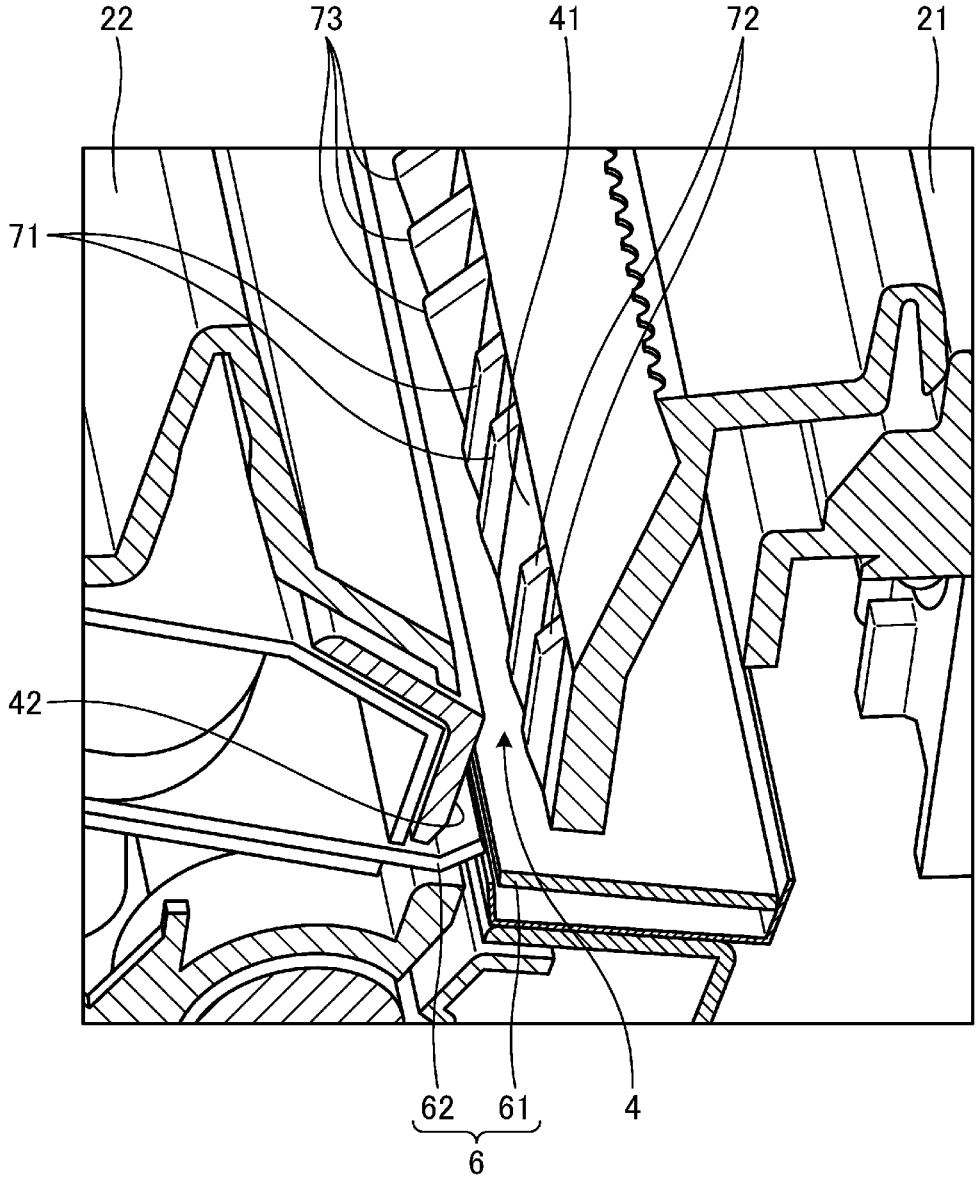
FIG. 5 is a perspective view showing an example of the shape of a first protrusion.

FIG. 5 is a perspective view showing an example of the shape of the first protrusions 71 to 73. The first protrusions 74 to 76, which are not shown in FIG. 5, have the same shape as the first protrusion 73. As shown in this drawing, the first protrusion 73 and others have a mountain shape, and the first protrusions 71 and 72 have a trapezoidal shape. More details will be described with reference to FIGS. 6-1 and 6-2.

Figures 1, 6:
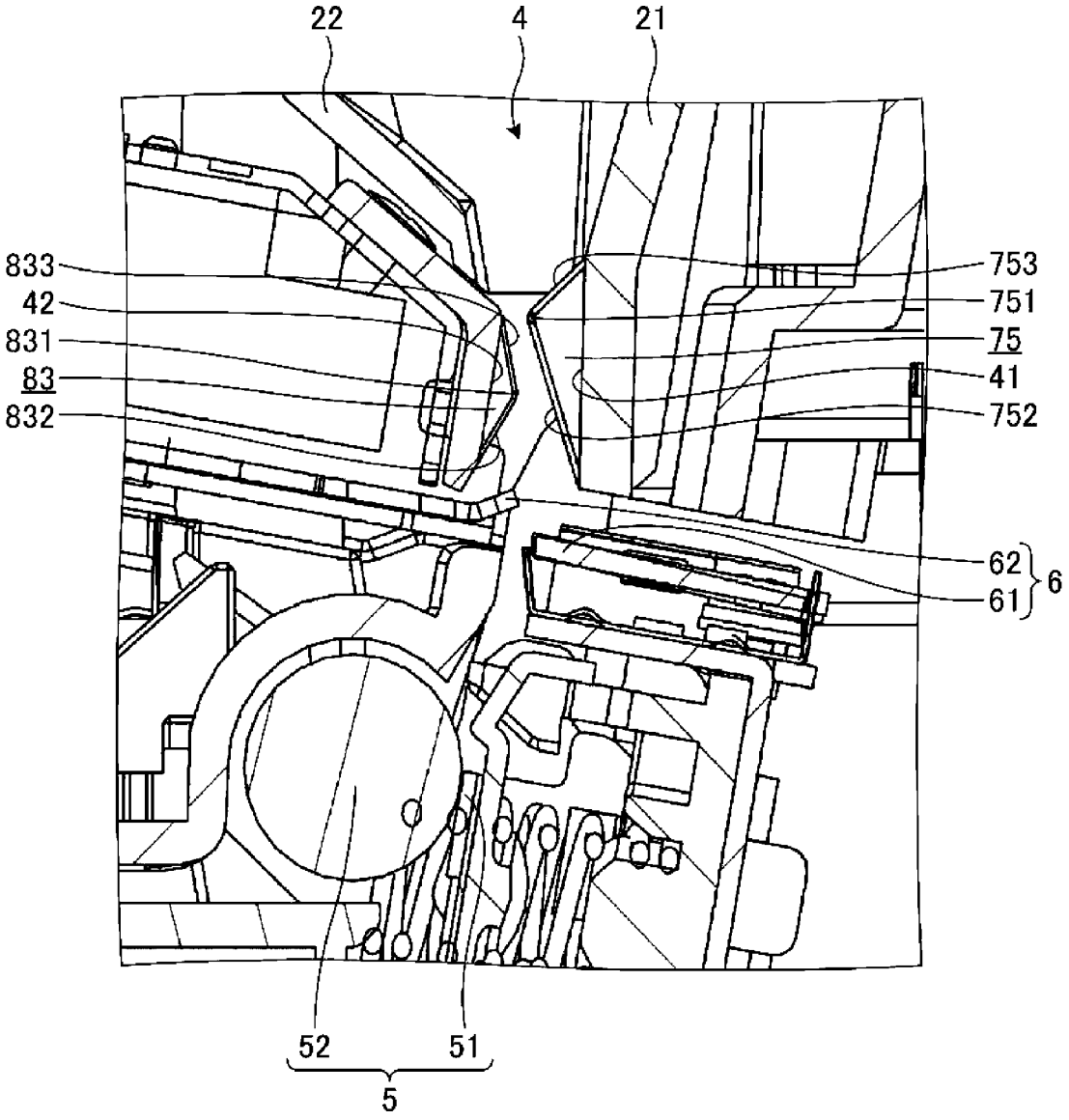
Figures 2, 6:
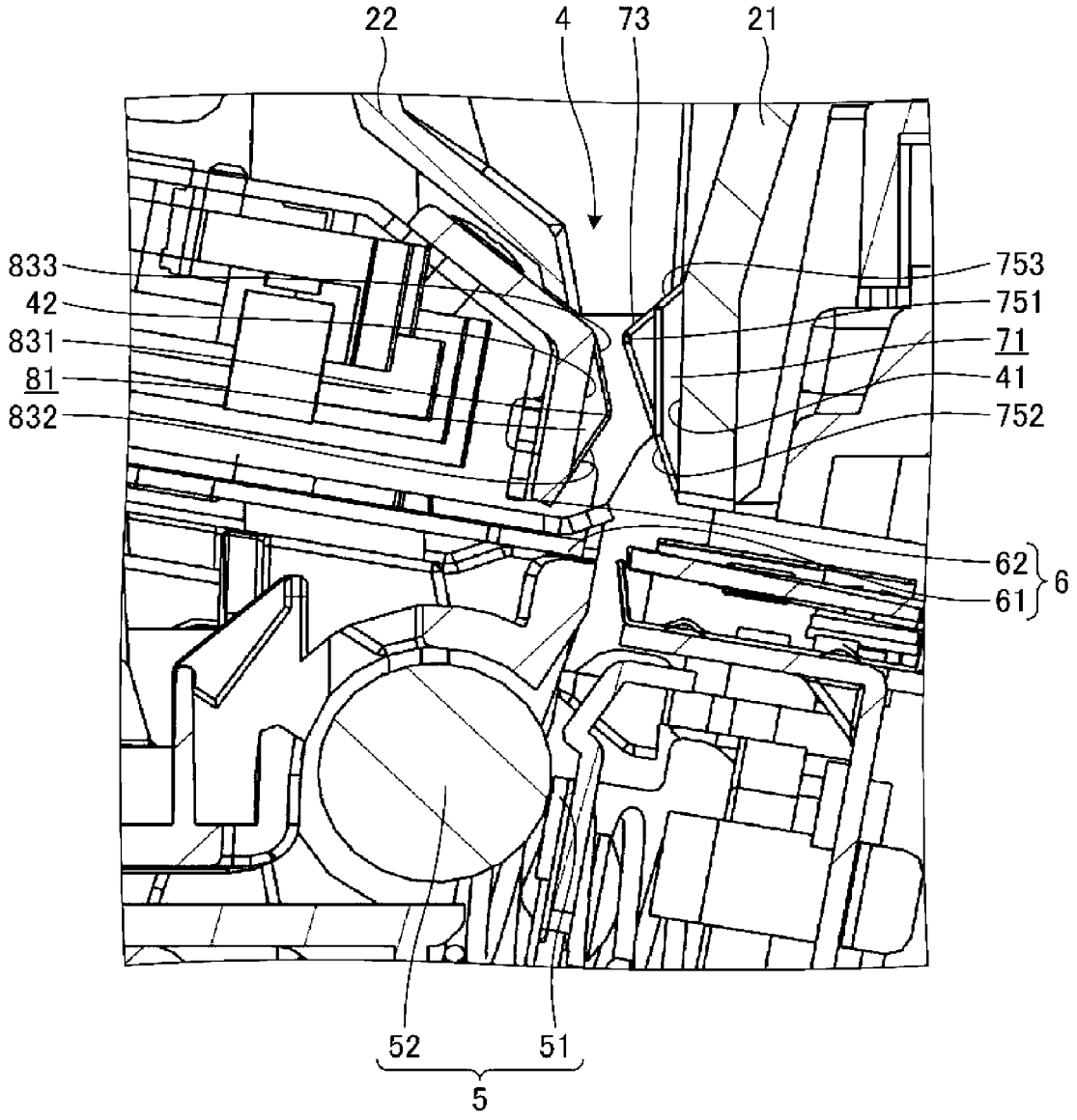

FIGS. 6-1 and 6-2 are drawings showing a partial cross-sectional view of the passage path of the sheet 91 in the sheet ejection port 4. FIG. 6-1 is a cross section taken along the line A-A in FIG. 3 and FIG. 6-2 is a cross section taken along the line B-B in FIG. 3. FIGS. 6-1 and 6-2 are drawings as viewed from the width direction of the sheet 91.

As shown in FIG. 6-1, the mountain-shaped first protrusion 75 includes a top 751, a hypotenuse 752 rising diagonally from the inner peripheral surface 41 of the sheet ejection port 4 from the upstream side to the downstream side in the sheet conveyance direction to reach the top 751, and a side 753 descending from the top 751 to the inner peripheral surface 41.

The side 753 is an edge portion of the first protrusion 75 on the downstream side in the sheet conveyance direction. The side 753 extends in a direction intersecting the sheet conveyance direction and the sheet width direction. Since such a side 753 is not parallel to the lower side of the fully cut sheet 91, the fully cut sheet 91 can be supported.

Further, the second protrusion 83 (the same applies to the second protrusions 81 and 82) has a mountain shape similar to that of the first protrusions 73 to 76. That is, the second protrusion 83 includes a top 831, a hypotenuse 832 rising diagonally from the inner peripheral surface 42 of the sheet ejection port 4 from the upstream side to the downstream side in the sheet conveyance direction to reach the top 831, and a side 833 descending from the top 831 to the inner peripheral surface 42.

Next, as shown in FIG. 6-2, the first protrusion 71 (the same applies to the first protrusion 72) having a lower protrusion height than the other first protrusions 73 to 76 in the central portion in the width direction of the sheet has a trapezoidal shape. More specifically, the first protrusions 71 and 72 have a shape in which a predetermined height including the top 751 is removed from the same mountain shape as the first protrusion 75 to be substantially parallel to the surface 41. Therefore, the first protrusions 71 and 72 have a short hypotenuse 752 and a side 753.

Further, in the present embodiment, the first protrusions 7 and the second protrusions 8 are provided to be positioned to deviate from each other in the sheet conveyance direction. As a result, the shape of the sheet conveyance path seen from the sheet width direction includes S-shaped undulation instead of a straight line, as shown in FIGS. 6-1 and 6-2.

More specifically, the first protrusions 7 are arranged to be located above the second protrusions 8 (that is, on the downstream side in the sheet conveyance direction). Further, in the present embodiment, the first protrusions 7 (71 to 76) are provided more than the second protrusions 8 (81 to 83), and therefore, the distance between the first protrusions 7 (71 to 76) is narrow. As a result, the first protrusion 7 is suitable as a place where the fully cut sheet 91 is placed and stacked (accumulated).

Further, in the present embodiment, the first protrusions 7 and the second protrusions 8 are provided so that the hypotenuse 752 and the side 833 face each other through the gap when viewed from the sheet width direction. As a result, the first protrusions 7 and the second protrusions 8 do not overlap (are not superimposed) when viewed from the sheet width direction. This structure and the shape of the sheet conveyance path including the S-shaped undulation described above make it possible to realize a moderate holding of the sheet 91 in the sheet ejection port 4 of the present embodiment. Moderate holding here means that the fully cut sheet 91 can be held between the first protrusion 7 and the second protrusion 8 to the extent that jam does not occur between the first protrusion 7 and the second protrusion 8 while the cutting unit 6 is in a partial cut operation.

Figure 7:
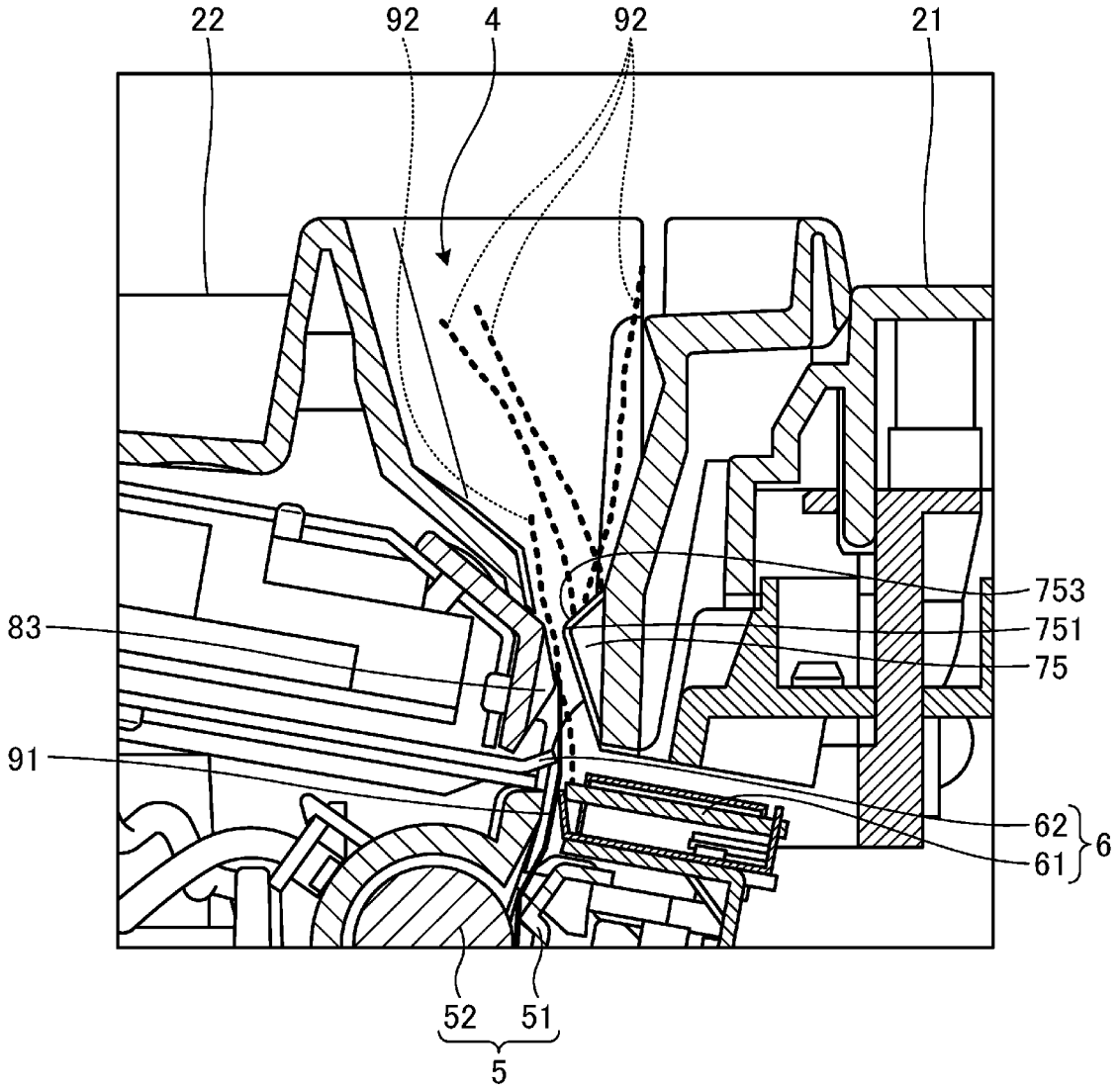
FIG. 7 is a diagram showing a partial cross-sectional view of a state of the ejection and stacking of fully cut sheets.

FIG. 7 is a diagram showing a partial cross-sectional view of the state of ejection and stacking of a fully cut sheet 92. If the cutting unit 6 cuts the sheet 91 printed by the printing unit 5, in the case of full cut, the cut sheet 92 is held by the addition of the undulating force in the sheet width direction between the first protrusion 7 and the second protrusion 8. This prevents the occurrence of the inconvenience that the sheet 92 falls between the fixed blade 61 and the movable blade 62 and is cut twice.

If the next sheet 91 is conveyed in the above-mentioned state, the sheet 91 partially overlaps with the cut sheet 92 in the thickness direction between the first protrusion 7 and the second protrusion 8. If the sheet 91 is further conveyed, a frictional force acts on the contact surface between the sheet 91 and the sheet 92, and the sheet 92 is conveyed together with the sheet 91. The sheet 92 that passed through the top 751 is stacked on the side 753 of the first protrusion 7.

Figures 1, 8:
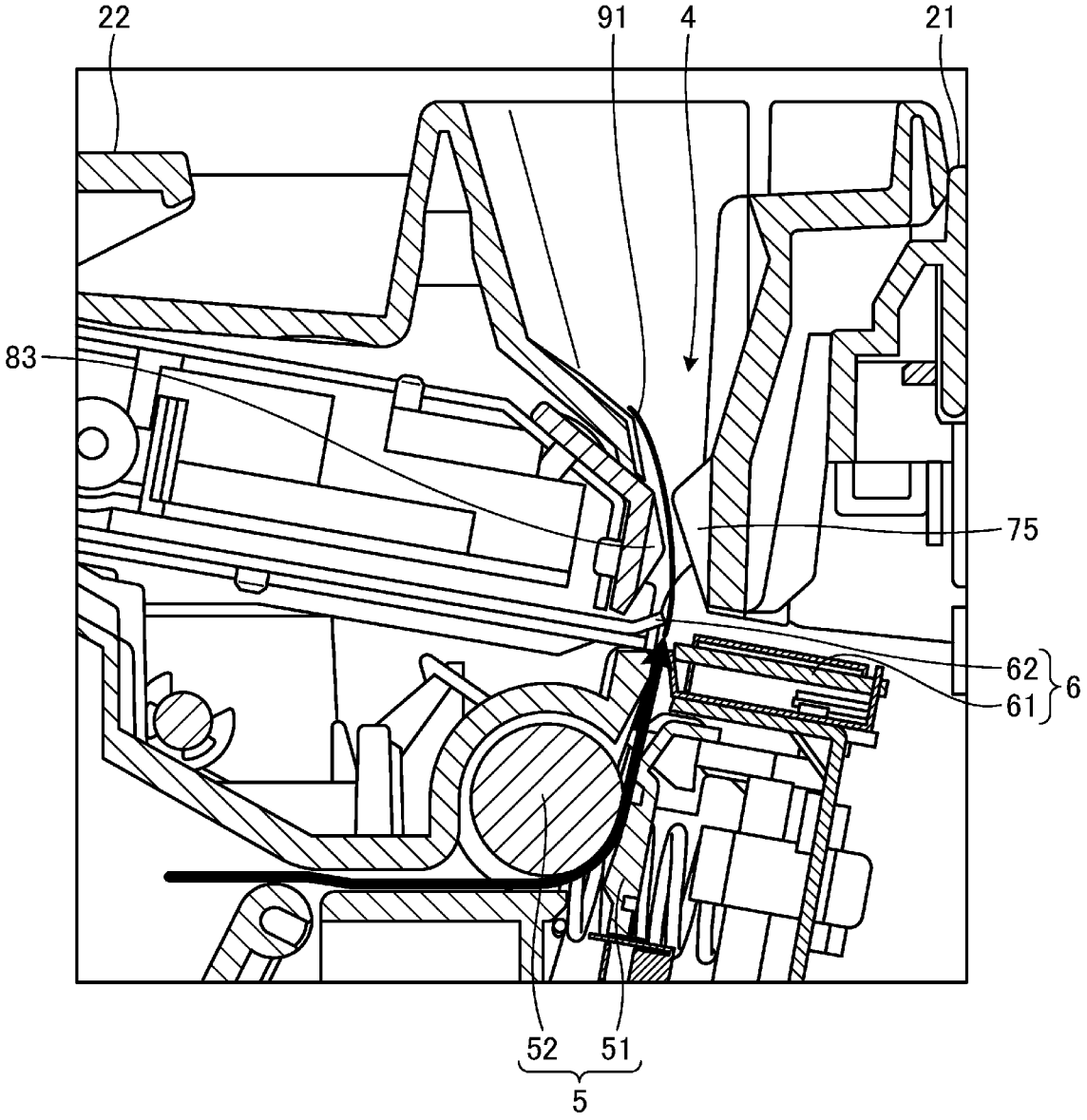
Figures 2, 8:
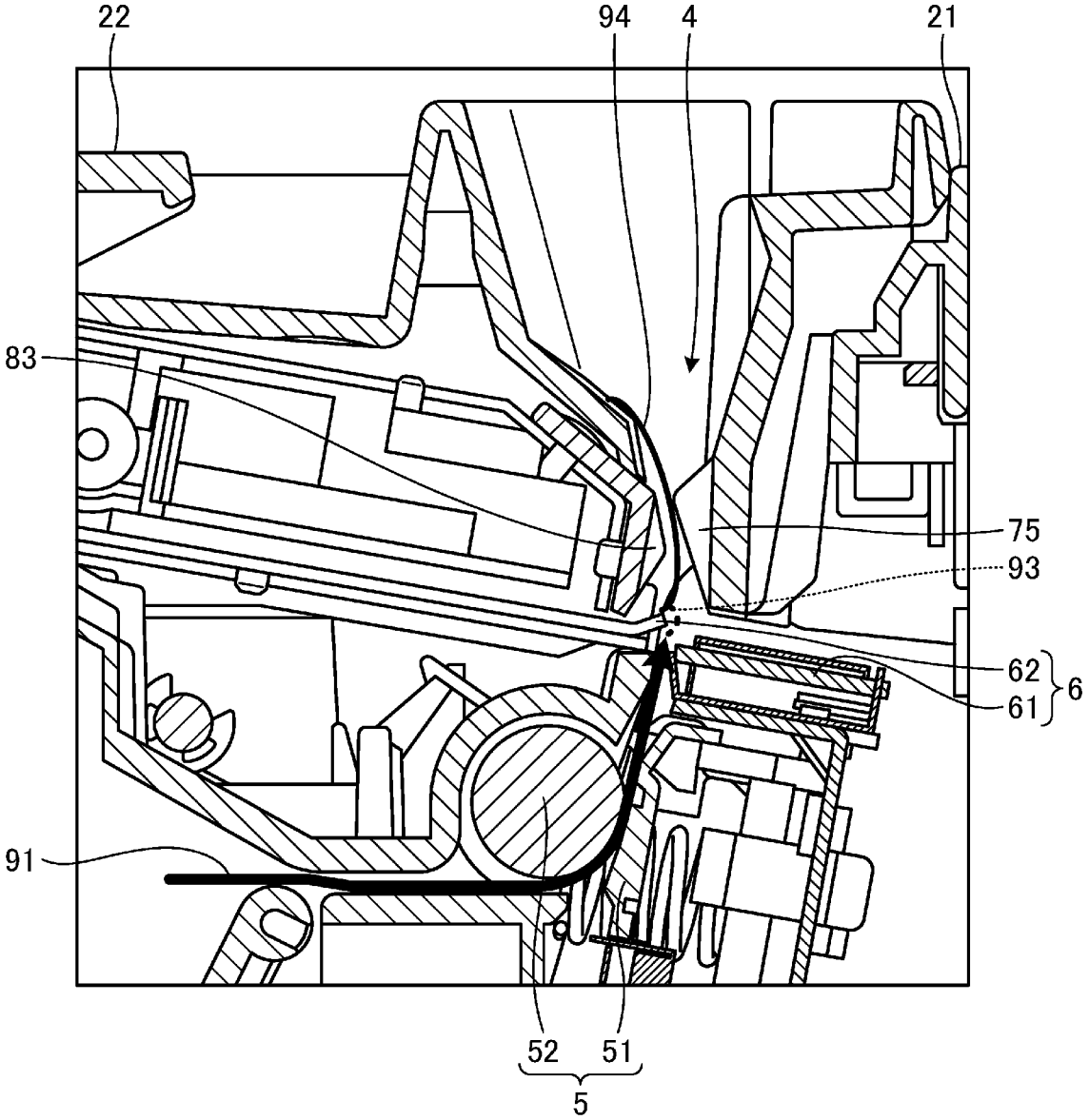
Figures 3, 8:
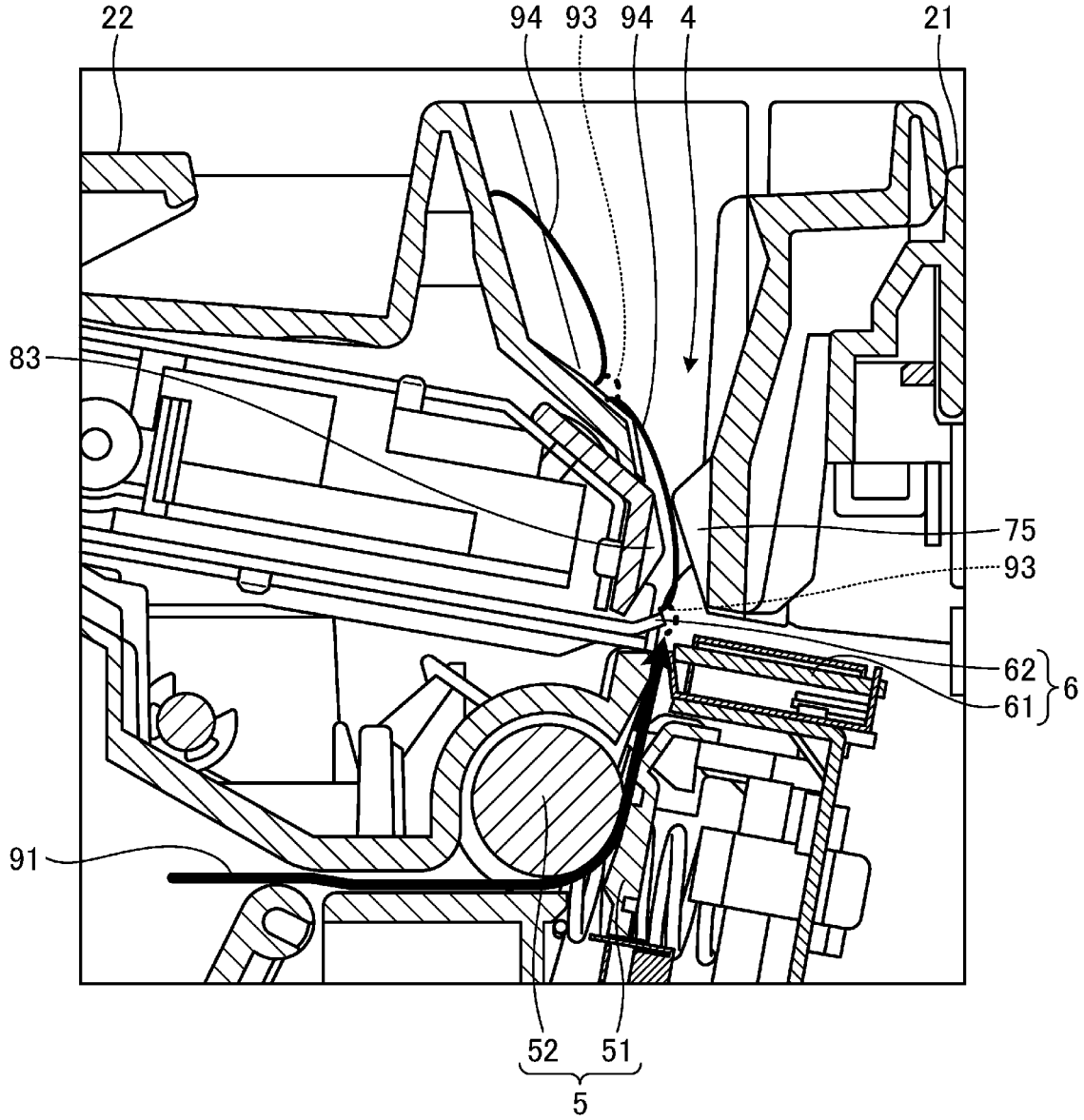

FIGS. 8-1 to 8-3 are diagrams showing a partial cross-sectional view of the state of the ejection of the sheet 91 in the partial cut. The sheet 91 shown in FIG. 8-1 is in a state before being cut by the cutting unit 6. If the sheet 91 is partially cut by the cutting unit 6, the state shown in FIG. 8-2 is obtained. In FIG. 8-2, reference numeral 93 indicates a location (connected portion) 93 in which both ends are cut off and the central portion is connected. Further, reference numeral 94 indicates a portion (partially cut sheet) 94 on the downstream side of the connected portion 93.

Figure 9:
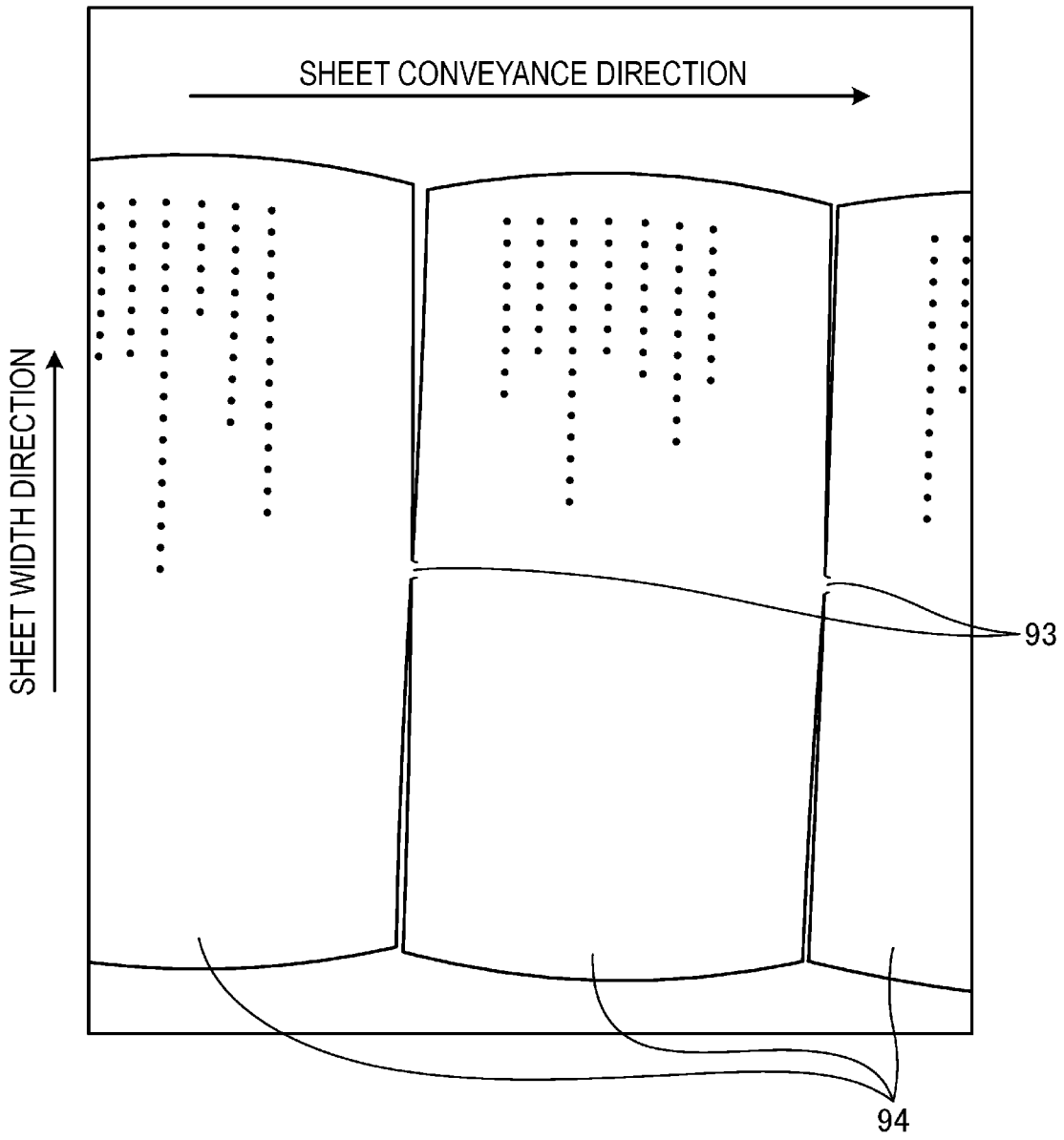
FIG. 9 is a realistic view of a partially cut sheet and a connected portion.

Here, FIG. 9 is a diagram realistically showing the partially cut sheet 94 and the connected portion 93. As shown in this drawing, the connected portion 93 between the partially cut sheet 94 and the sheet 94 is actually a portion having no length that can be illustrated when viewed from the sheet width direction, but for convenience of description, the connected portion is represented by dotted lines in FIGS. 8-2 and 8-3.

As shown in FIG. 8-2, the lower ends of both ends in the width direction of the portion 94 on the downstream side of the connected portion 93 are curled toward the movable blade 62 according to the winding direction of the roll sheet 9. In this state, the portion 94 on the downstream side of the connected portion 93 (that is, the partially cut sheet) is held between the first protrusions 7 and the second protrusions 8 in the same manner as the fully cut sheet 92.

In the case of partial cut, the conveyed sheet 91 and the portion 94 do not overlap in the thickness direction, and thus, the sheet 91 pushes up the portion 94 only by the connected portion 93. Therefore, if the portion 94 is held too strongly by the protrusions 7 and 8, a jam will occur. As a countermeasure, in the printer 1 of the present embodiment, first, the distance between the first protrusion 7 and the second protrusion 8 in the central portion in the sheet width direction is wider than in other regions (both ends in the sheet width direction). As a result, the load applied to the connected portion 93 and its peripheral portion is smaller than that in the other regions.

Further, in the printer 1 of the present embodiment, the first protrusions 7 and the second protrusions 8 are arranged to face each other through a gap when viewed from the sheet width direction and not to overlap when viewed from the sheet width direction. According to such an embodiment, the inconvenience that the sheet 91 is held too strongly is eliminated.

Moreover, in the printer 1 of the present embodiment, the first protrusion 7 and the second protrusion 8 are positioned to deviate from each other in the sheet conveyance direction, whereby the sheet conveyance path seen from the sheet width direction has an undulating shape such as an S-shape. As a result, the fully cut sheet 92 is less likely to fall to the cutting unit 6, and the inconvenience that the sheet 92 is cut twice by the cutting unit 6 is less likely to occur.

If the sheet 91 is conveyed from the state of FIG. 8-2, the next printing is performed, and the next partial cut is performed, the state shown in FIG. 8-3 is obtained. As shown in FIGS. 8-2 and 8-3, the partially cut portion 94 of the sheet 91 is curled according to the winding direction of the roll sheet 9 and with a curvature according to the remaining diameter of the roll sheet 9. As a countermeasure against jam caused by this curl, the protrusions 7 and 8 of the present embodiment are arranged to realize a sheet conveyance path (preferably a sheet conveyance path bent in the curl direction of the portion 94) that does not go against the curl direction of the portion 94. According to such an embodiment, even if the curl of the sheet 91 is strong, jam is unlikely to occur.

As described above, according to the present embodiment, it is possible to provide the printer 1 having a structure in which the fully cut sheet 92 to be ejected upward can be held and the partially cut portion 94 is less likely to be jammed.

In the present embodiment, the protrusions 7 and 8 have a rib-like shape, and the holding force of the sheet 91 at the sheet ejection port 4 is adjusted depending on the number of ribs. At the time of implementation, the protrusions 7 and 8 may be configured, for example, by the coexistence of thick convex portions and thin convex portions in the sheet width direction.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a printing component configured to print on a strip-shaped sheet;

a housing configured to house the strip-shaped sheet and the printing component, and comprising a sheet ejection port for ejecting the strip-shaped sheet that passes through the printing component upward;

a cutting component arranged between the printing component and the sheet ejection port and configured to cut the strip-shaped sheet by either a first method of cutting the strip-shaped sheet in an entire width direction or a second method of cutting the strip-shaped sheet and leaving uncut a central portion of the strip-shaped sheet in the width direction;

first protrusions protruding from an inner periphery of the sheet ejection port, and provided at a plurality of locations along the width direction of the sheet to face a first surface of the strip-shaped sheet on a printing side; and second protrusions protruding from the inner periphery of the sheet ejection port, provided at a plurality of locations along the width direction of the strip-shaped sheet at positions deviated from the first protrusions in the sheet width direction to face a second surface, which is a back surface of the first surface of the strip-shaped sheet, and configured to bend the strip-shaped sheet in an undulating shape in the width direction between the first protrusions and the second protrusions, wherein a protrusion height of at least one of the first protrusions and the second protrusions in a predetermined region of the central portion in the width direction of the strip-shaped sheet is lower than protrusion heights of the first protrusions and the second protrusions in other regions.

2. The printer according to claim 1, wherein the first protrusions and the second protrusions are provided to deviate from each other in a sheet conveyance direction.

3. The printer according to claim 2, wherein the first protrusions and the second protrusions are plate-shaped, are provided side by side in the sheet width direction with a plate thickness direction facing the sheet width direction, and have a mountain shape formed by a hypotenuse rising diagonally from an inner peripheral surface of the sheet ejection port from an upstream side to a downstream side in the sheet conveyance direction to reach a top, and a side descending from the top to the inner peripheral surface.

4. The printer according to claim 3, wherein an edge portion of the first protrusions on the downstream side in the sheet conveyance direction extends in a direction intersecting the sheet conveyance direction and the sheet width direction.

5. The printer according to claim 3, wherein of the first protrusions and the second protrusions in the central portion in the width direction of the sheet, those having a lower protrusion height have a trapezoidal shape in which a height from the top to a predetermined height is removed along the inner peripheral surface.

6. The printer according to claim 3, wherein the first protrusions and the second protrusions are provided so that edges of the first protrusions and the second protrusions face each other through a gap when viewed from the sheet width direction.

7. A thermal printer, comprising:

a thermal printing component configured to print on a strip-shaped sheet;

a housing configured to house the strip-shaped sheet and the printing component, and comprising a sheet ejection port for ejecting the strip-shaped sheet that passes through the printing component upward;

a cutting component arranged between the printing component and the sheet ejection port and configured to cut the strip-shaped sheet by either a first method of cutting the strip-shaped sheet in an entire width direction or a second method of cutting the strip-shaped sheet and leaving uncut a central portion of the strip-shaped sheet in the width direction;

first protrusions protruding from an inner periphery of the sheet ejection port, and provided at a plurality of locations along the width direction of the sheet to face a first surface of the strip-shaped sheet on a printing side; and second protrusions protruding from the inner periphery of the sheet ejection port, provided at a plurality of locations along the width direction of the strip-shaped sheet at positions deviated from the first protrusions in the sheet width direction to face a second surface, which is a back surface of the first surface of the strip-shaped sheet, and configured to bend the strip-shaped sheet in an undulating shape in the width direction between the first protrusions and the second protrusions, wherein a protrusion height of at least one of the first protrusions and the second protrusions in a predetermined region of the central portion in the width direction of the strip-shaped sheet is lower than protrusion heights of the first protrusions and the second protrusions in other regions.

8. The thermal printer according to claim 7, wherein the first protrusions and the second protrusions are provided to deviate from each other in a sheet conveyance direction.

9. The thermal printer according to claim 8, wherein the first protrusions and the second protrusions are plate-shaped, are provided side by side in the sheet width direction with a plate thickness direction facing the sheet width direction, and have a mountain shape formed by a hypotenuse rising diagonally from an inner peripheral surface of the sheet ejection port from an upstream side to a downstream side in the sheet conveyance direction to reach a top, and a side descending from the top to the inner peripheral surface.

10. The thermal printer according to claim 9, wherein an edge portion of the first protrusions on the downstream side in the sheet conveyance direction extends in a direction intersecting the sheet conveyance direction and the sheet width direction.

11. The thermal printer according to claim 9, wherein of the first protrusions and the second protrusions in the central portion in the width direction of the sheet, those having a lower protrusion height have a trapezoidal shape in which a height from the top to a predetermined height is removed along the inner peripheral surface.

12. The thermal printer according to claim 9, wherein the first protrusions and the second protrusions are provided so that edges of the first protrusions and the second protrusions face each other through a gap when viewed from the sheet width direction.

13. A POS terminal, comprising:

a commodity registration device;

a commodity settlement device; and a printer, comprising:

a printing component configured to print on a strip-shaped sheet;

a housing configured to house the strip-shaped sheet and the printing component, and comprising a sheet ejection port for ejecting the strip-shaped sheet that passes through the printing component upward;

a cutting component arranged between the printing component and the sheet ejection port and configured to cut the strip-shaped sheet by either a first method of cutting the strip-shaped sheet in an entire width direction or a second method of cutting the strip-shaped sheet and leaving uncut a central portion of the strip-shaped sheet in the width direction;

first protrusions protruding from an inner periphery of the sheet ejection port, and provided at a plurality of locations along the width direction of the sheet to face a first surface of the strip-shaped sheet on a printing side; and second protrusions protruding from the inner periphery of the sheet ejection port, provided at a plurality of locations along the width direction of the strip-shaped sheet at positions deviated from the first protrusions in the sheet width direction to face a second surface, which is a back surface of the first surface of the strip-shaped sheet, and configured to bend the strip-shaped sheet in an undulating shape in the width direction between the first protrusions and the second protrusions, wherein a protrusion height of at least one of the first protrusions and the second protrusions in a predetermined region of the central portion in the width direction of the strip-shaped sheet is lower than protrusion heights of the first protrusions and the second protrusions in other regions.

14. The POS terminal according to claim 13, wherein the first protrusions and the second protrusions are provided to deviate from each other in a sheet conveyance direction.

15. The POS terminal according to claim 14, wherein the first protrusions and the second protrusions are plate-shaped, are provided side by side in the sheet width direction with a plate thickness direction facing the sheet width direction, and have a mountain shape formed by a hypotenuse rising diagonally from an inner peripheral surface of the sheet ejection port from an upstream side to a downstream side in the sheet conveyance direction to reach a top, and a side descending from the top to the inner peripheral surface.

16. The POS terminal according to claim 15, wherein an edge portion of the first protrusions on the downstream side in the sheet conveyance direction extends in a direction intersecting the sheet conveyance direction and the sheet width direction.

17. The POS terminal according to claim 15, wherein of the first protrusions and the second protrusions in the central portion in the width direction of the sheet, those having a lower protrusion height have a trapezoidal shape in which a height from the top to a predetermined height is removed along the inner peripheral surface.

18. The POS terminal according to claim 15, wherein the first protrusions and the second protrusions are provided so that edges of the first protrusions and the second protrusions face each other through a gap when viewed from the sheet width direction.

19. The POS terminal according to claim 13, wherein the printer is a thermal printer and the printing component is a thermal printing component.

20. The POS terminal according to claim 13, wherein the printer is a portable printer.

* * * * *